United States Patent [19]

Eickmann

[11] Patent Number: 4,546,743

[45] Date of Patent: Oct. 15, 1985

[54] ARRANGEMENTS TO ROTARY VALVES FOR ENGINES COMPRESSORS, MOTORS OR PUMPS

[76] Inventor: Karl Eickmann, 2420 Isshiki, Hayama-machi, Kanagawa-ken, Japan

[21] Appl. No.: 364,574

[22] Filed: Apr. 1, 1982

Related U.S. Application Data

[63] Continuation-in-part of Ser. No. 807,975, Jun. 20, 1977, abandoned.

[51] Int. Cl.[4] ..... F01L 7/02

[52] U.S. Cl. ..... 123/190 A; 123/190 DL; 123/190 E

[58] Field of Search ..... 123/190 A, 190 DL, 191

[56] References Cited

FOREIGN PATENT DOCUMENTS

| | | | |
|---|---|---|---|
| 506159 | 8/1920 | France | 123/190 A |
| 138904 | 5/1921 | United Kingdom | 123/190 A |
| 423474 | 2/1935 | United Kingdom | 123/190 DL |

*Primary Examiner*—Ira S. Lazarus
*Assistant Examiner*—R. S. Bailey

[57] ABSTRACT

A rotary valve with an axially extending passage revolves in a bed of a valve bearing body which has inlet passage means and a fluid transfer channel. The valve controls the periodic flow of fluid from the inlet means to the transfer channel. Fluid pressure containing pockets are provided diametrically of the transfer channel to let the rotary valve member float between opposed pressure fields. Accessary means can be provided to the rotary valve to secure equal forces at equal times on diametrically opposed portions of the outer face of the rotary valve member.

5 Claims, 16 Drawing Figures

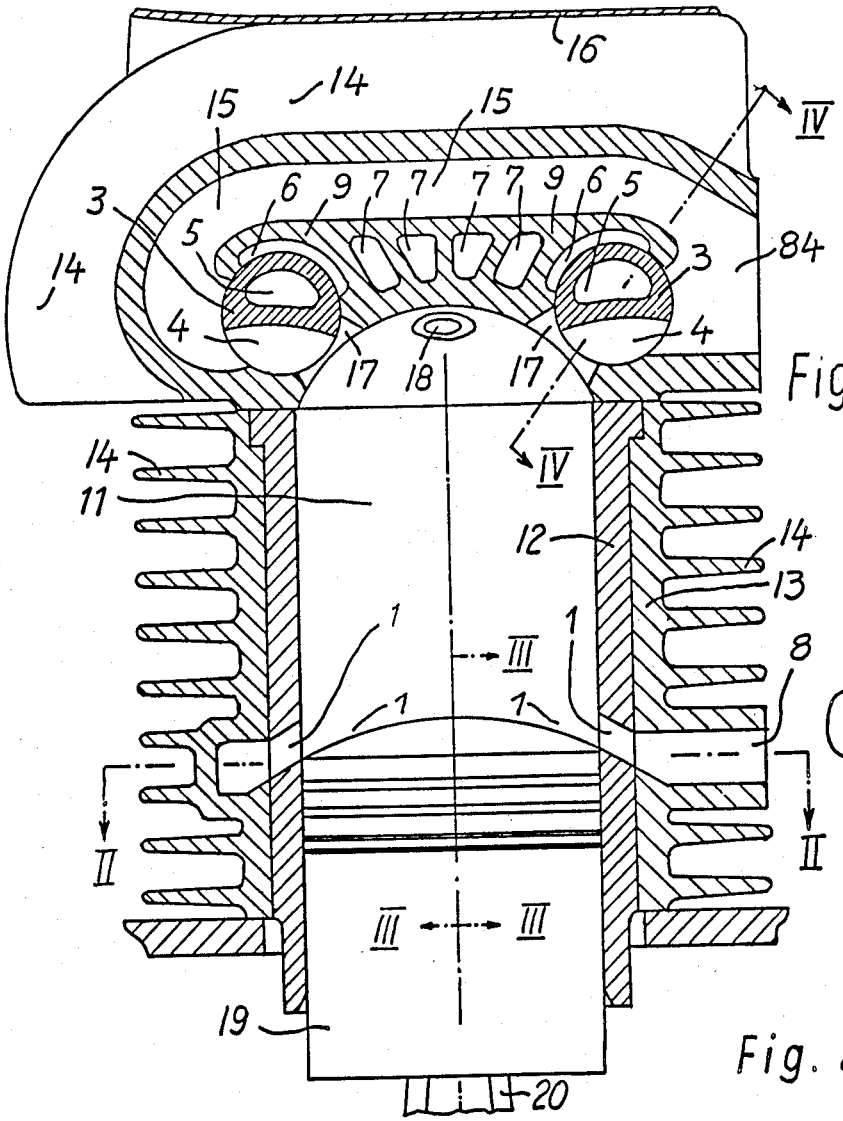
Fig. 1
Fig. 3
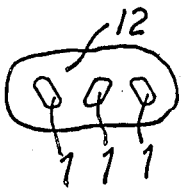
Fig. 2
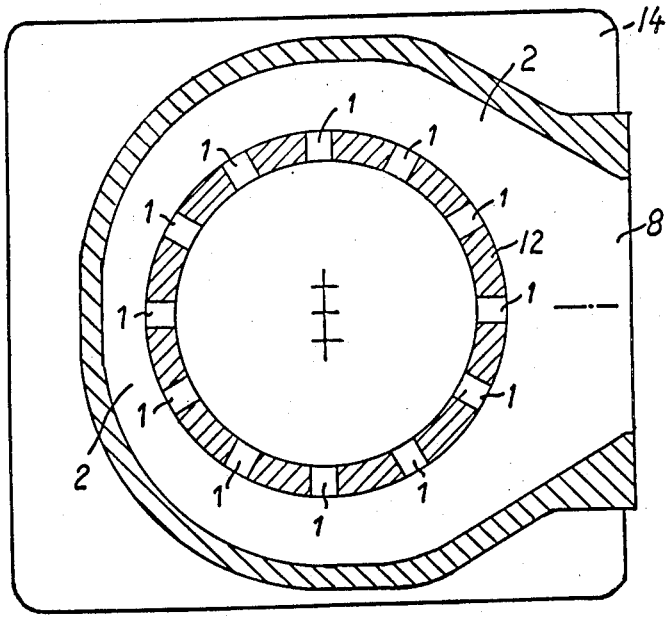

ARRANGEMENTS TO ROTARY VALVES FOR ENGINES COMPRESSORS, MOTORS OR PUMPS

REFERENCE TO A RELATED APPLICATION

This is a continuation in part application of my copending application, Ser. No. 807,975, which was filed on June 20, 1977 now abandoned.

BACKGROUND OF THE INVENTION

Four-stroke and two-stroke combustion engines are widely used and each of them has features and also difficulties. The features of the four-stroke engines is the good efficiency because the cylinder is cleaned out by force after each working stroke. Since at four strokes only one working stroke appears, the engines are of less power per unit of weight.

The two-stroke engines have big power per unit of weight, because they have a working stroke at every two strokes. However their efficiencies are bad, because the cylinders are not cleaned by force. Therefore full filling with clean gas-air mixture is not assured.

A difficulty of both types of common engines is, that the cross-sectional areas for intake and exhaust are limited because there is not enough space for a maximum of inlet and exhaust area.

SUMMARY OF THE INVENTION OF THE PARENTAL APPLICATION

The purpose of this invention is, to at least partially overcome the mentioned difficulties of the known common combustion engines and at the same time to increase the reliability, the power per unit of weight and under certain conditions also to increase the efficiency of the engines.

One object of the invention is to do away with the outlet valves and the exhaust pipes of the four stroke engines. Because the outlet valves are subjected to high heat, which reduces their life time and reliability.

A means of said object of the invention is, to provide outlet slots above the bottom position of the piston through the cylinder walls.

Another object of the invention is, to provide an exhaust collection chamber around the said slots in the cylinder walls.

A further object of the invention is, to provide said slots angularly spaced around the whole cylinder wall portion, whereby a maximum of outlet cross-sectional area is obtained, while at same design the slots can be short in the direction of the piston stroke.

It is therefore another object of the invention, to increase the cross-sectional area of outlet slots in combination with shortening of their height in order to obtain a maximum of closed working space in the cylinder.

Another object of the invention is, to set a drive unit for driving a loader, for example a common super charger unit directly onto the exhaust outlet without the need of piping around a half of the engine.

A related object of the invention is, to use said loader or turbocharger directly before the inlet valve without need of piping around a half of the engine.

A further object of the invention is, to utilize an inlet valve of higher speed, more reliability and of bigger inlet area.

Another object of the invention is, to set a plurality of inlet valves in order to increase the inlet area and/or in order to allow higher rmp of the engine.

Another object of the invention is, to provide a high speed rotary inlet valve.

A further object of the invention is, to provide balancing means and cooling means to a rotary inlet valve in order to improve the tightness and life time as well as reliability of the inlet valve.

A still further object of the invention is, to provide space for double ignition plugs.

Another object of the invention is, to provide an improved cylinder head of easy configuration for easy machining, better cooling and prevention of the heated complicationed portions of the cylinder head of former four stroke engines in the surrounding of the former outlet valves of the former engines.

Still a further object of the invention is to provide at least two inlet streams whereof one is a pure air stream for cleaning of the cylinder from exhaust gases and the other is an air-mixture stream for filling of the cylinder with cumbustible mixture.

And a final object of the invention is, to provide a turbo- or other charger with two supply chambers for compressed gas. One thereof for clean pure air, while the other may be for air-fuel mixture.

With said objects of the invention materialized by this present invention, the common four stroke engine can keep its parts, but has to replace only the cylinder block and the valve head or inlet head. By setting the cylinder block and the inlet head together with the loading unit to the engine, the power of the common heretofore four-stroke engine becomes 3.5 fold by this invention. Because the turbocharger doubles the power generally, while the transformation by this invention changes the engine from four-stroke to two-stroke whereby the number of working strokes is doubled and consequently the power respectively increased. The efficiency of the four stroke system is fully maintained by the invention, because the cylinder is cleaned by force. This was not possible by common two stroke engines. A little bit working volume of about 10 percent is lost by the provision of the outlet slots of the invention, but the increase in power is so extensive, that this little loss can be accepted.

For higher efficiency the engine can run with a high air-ratio "lambda", whereby the thermal and overall efficiency increases.

SUMMARY OF THE INVENTION OF THIS PRESENT APPLICATION

The object of the invention is, to provide a rotary valve arrangement with a rotary valve member revolving in a bed of a valve bearing body, wherein local lateral forces out of the transfer channel onto the valve are opposed by diametrically oppositionally acting forces on diametrically oppositely located portions of the rotary valve member.

Another object of the invention is, to utilize fluid pressure pockets to secure the counter acting forces on the opposite portion of the rotary valve member.

And, a still further object of the invention is, to provide accessory flow separation and control valve arrangements to secure a timed relation and a pressure parallelity between opposing forces on the outer face of the rotary valve member;

while it is partially also an object of the invention, to provide a stable location of the rotary valve member in the bed, wherein it revolves whereby undesired centric or eccentric locations of the rotary valve are prevented and a predetermined location of the axis of the rotary valve relatively to the axis of the bed, wherein the valve revolves, is secured.

BRIEF DESCRIPTION OF THE DRAWING

FIG. 1 is a longitudinal sectional view through an engine portion of the invention.

FIG. 2 is a cross-sectional view through FIG. 1 along II—II.

FIG. 3 is a view from inside the cylinder along III—III.

DESCRIPTION OF THE PREFERRED EMBODIMENTS

Figure 4:
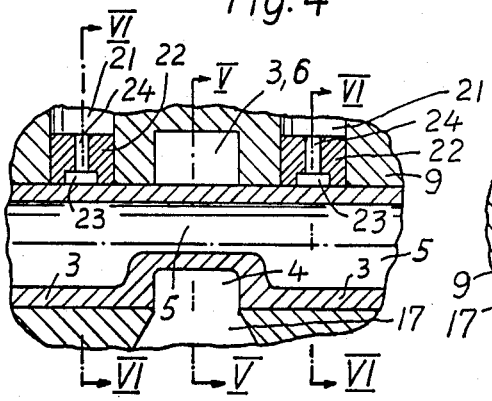
FIG. 4 is a partial sectional view through FIG. 1 along IV—IV.

Cylinderliners 12 which are also called the cylinder bushes form the cylinder 11 which is closed on top by the cylinder head 9. From bottom of the there open cylinder 11 the piston 19 moves upward and downward within cylinder 11. The piston 19 is driven and drives the commonly used crankshaft over the conrod 20, which is the connecting rod between the crankshaft and the piston. Thus, the piston moves up and down in the cylinder and thereby compresses and expands the cylinder space. This known cycle is used to compress air or air-fuel mixture, to ignite it, combust it and utilize the burning or burned gases to drive the piston in the expansion stroke, which gives the power to the engine. Thereafter the expanded gases are exhausted out from the cylinder. The words "up" and "down" are used in relation to FIG. 1, and so are the referentials mentioned in the above description of the common engine of the former art.

There were and are two major difficulties in those engines of the former art. In two-stroke engines the cylinder could not be cleaned by force. Therefore, old burned gases remained remained partially in the cylinder. That prevented clean burning of the new charge with best efficiency. The application of entrance of mixture under pre-compression in the crankcase of two-stroke engines made double sets of parts necessary in the cylinder walls. Since there in only limited space in a cylinder wall, the cross-sectional areas of the entrance and exit slots in two stroke engines could not become widely enlarged, as the enlargement of said cross-sectional areas is limited. Thus, the power and efficiency of the common two-stroke engines could not be increased without limit. The common four-stroke engine does not have the difficulties of cleaing of the cylinder from residue of burned gases. Because it has a specific exhaust stroke, which sends the remainder of burned gases of the prior working stroke by use of force of the moving piston. However, in order to achieve this feature of good cleaning and loading of the cylinder the four stroke engine has to use inlet valves and outlet valves, which must be timely opened and closed by mechanical drive means. The exhaust or outlet valve is subjected to the heat of the hot outgoing gases. It operates in this heat.

The heat on the outlet valve and its surrounding parts and portions is therefore a main limitation to the existing four stroke engines. The requirement of four piston strokes or two revolutions in order to achieve a single working or power stroke limits the power of four stroke engines per unit of weight.

By this present invention these mentioned difficulties of four stroke-and of two stroke engines of today's common use will at least partially or almost completely be overcome.

For this purpose, the invention prevents the application of exhaust valves. Instead it provides the slots 1 of the invention through the cylinder wall 12. Said slots 1 are set so, that they are slightly above the most downward position of the piston 19. It is preferred to provide an annullar exhaust collection space 2 around the cylinder bush 12. The ports or slots 1 of the invention open and communicate to said exhaust collection space or exhaust collection chamber 2.

Collection chamber 2 may be made of increased cross-sectional area towards the exhaust port 8 in order to obtain equal velocities over the entire exhaust collection chamber 2. In accordance with the invention it is possible to space the slots 1 of the invention regularly at angular intervals over the whole 360 degrees of the cylinder wall. This is demonstrated in cross-sectional FIG. 2. Said FIG. 2 also demonstrates the preferred enlargement of cross-sectional area of collection chamber 2 towards the exhaust port 8.

Since the common two-stroke engine requires inlet slots and outlet slots, but the engine of this invention requires only outlet slots 1 in the bottom portion of the cylinder wall, it is clearly evident, that the exhaust slots 1 of the invention can be made substantially of twice the cross-sectional area of that of common two-stroke engines. Consequently in the engine of the invention it is substantially possible to exit twice as much burned gases, as in the common two-stroke engine.

The outlet slots 1 may be set in inclined angles as shown in FIG. 3 in order to have a good guide for the piston rings, so, that the piston rings will not break, when they move during piston stroke over the outlet slots 1 of the invention.

According to the here described preferred embodiment of the Figures of the invention, the exhaust port 8 is connected to a gas motor or to a turbocharger turbine unit. For example to entrance port 70 of FIG. 12. The gas-motor or turbine 71 drives a loader 69 which sucks in air or air-fuel mixture through entrance port 66 and supplies it as a compressed air or compressed mixture out of exit port 69 into entrance port 84 of the engine.

Instead of sending the exhaust gases through the gas motor or turbine 71, the exhaust gases can also be send through a muffler out into the atmosphere. In such case however a compressing unit or loader must be driven by other means. For example by the crankshaft or another rotary member of the engine or by an external power source.

Figure 12:
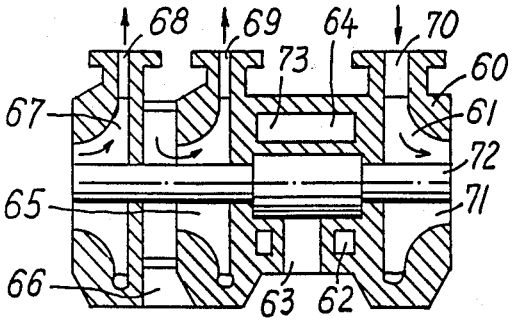
FIG. 12 is a longitudinal sectional view through a turbo-charger of the invention.

The most economic and the most convenient one, also not at all cases the most expensive one, is a turbocharger of FIG. 12 or a turbocharger with only one compressor. It will be noted, that, as commonly known, the shaft 72 is borne in bearing 73 and connects the expansion rotor 71 with compression rotor 65 for revolving both in unison. Lubricating chamber 64 lubricates shaft 72 in bearing 73 and exit port 63 is provided for the leaking lubrication fluid.

According to the preferred embodiment and also in accordance with the invention at least one inlet valve means 3 is provided in the cylinder head 9 of the engine of the invention. This valve means 3 is operated in cycle with the moving piston 19 and synchronized to piston 19 timely. That may be done by mechanical means, for example by common drive means, like, gear, chain, belt and the like. Inlet valve means 3 provides the opening and closing of inlet passage 4. Commonly there is also an inlet fluid collection or supply chamber before the inlet passage 4. That is however not shown in the drawing because it is commonly incorporated into the inlet passage from the loader to the inlet passage.

When the piston 19 moves downward and thereby opens the outlet slots 1 of the invention, the compressed air or air-fuel mixture enters through the then open entrance passage 4 into the clinder 11 and thereby presses the remainder of the old burned gases of former working stroke out of the cylinder 11 through the exit slots 1 of the invention. This continues until the later upwards moving piston 19 closes the slots 1 of the invention. After enough new air or air-fuel mixture will have filled the cylinder 11, the entrance passage 4 closes and the gas in the cylinder becomes compressed during the further compression stroke or upward move of piston 19. When the piston is near to its uppermost position either the air-fuel mixture becomes ignited by spark plugs 18 or fuel becomes injected into the hot air in the cylinder 11 by a fuel injection nozzle 18. Spark plug and fuel injection nozzle have equal referentials 18, because in accordance with the invention both are applicable alternatives. The engine can run in Otto-type ignition of air-fuel mixture or in Diesel type fuel injection into compressed hot air in the cylinder. Depending on compression ratio and other design considerations, the user of the engine of the invention selects either an ignition means 18 in the cylinder head or a fuel injection means 18 in the cylinder head 9.

The elimination of the exhaust valve in the cylinder head provides in accordance with this invention, much space in the cylinder head to set double ignition plugs 18 or to set double injection nozzles 18 into the cylinder head.

It also provides much space for cooling ribs or other cooling means. These provisions of the invention provide a higher reliability and a longer life to the engine.

The embodiment of the inlet valve shown in FIG. 1 is in detail demonstrated in FIGS. 1 and 4 to 6. It is rotatably borne in the cylinder head 9 or thereon. The rotation is provided by commonly known mechanical means, as chain, gear, belt and coupled into unison with the crankshaft or another moving member of the engine.

At right time, when the piston is near its bottom-most position and the slots 1 are opening, the inlet passage 4 opens the entrance from entrance port 84 into cylinder 11. The air or air fuel mixture is then forced by the loader, compressor or turbocompressor 69 into cylinder 11, until the said cylinder is free of exhaust gases and completely filled with new air or mixture. Thereafter by revolving further, the closing portion of the valve 3 closes the cylinder 11. Said closing portion of valve 3 is demonstrated in FIG. 5. The open position is demonstrated in FIGS. 1 and 4. Thus, FIG. 5 shows the valve 3 in a turned position.

Valve 3 may be a rotating shaft. It may be hollow and be provided with cooling passage 5 for cooling of the valve 3.

Figure 5:
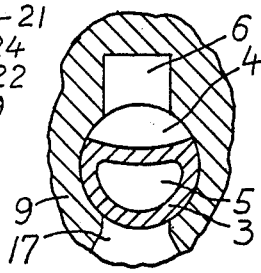
FIG. 5 is a cross-sectional view through FIG. 4 along V—V.
Figure 6:
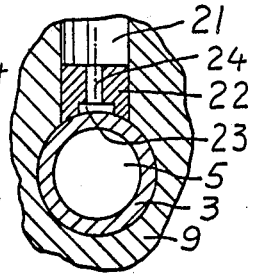
FIG. 6 is a cross-sectional view through FIG. 4 along VI—VI.

FIGS. 4 and 6 demonstrate, how it can be assured, that at closing position the valve 3 is alltimes closely sealingly pressed against the respective portion of the cylinder head 9. For that purpose the pressure chambers 21 may be provided in the cylinder head 9 or a respective bearing member. Thrust bodies 24 are axially moveable in said pressure chambers 21. Passage means 24 may extend through thrust body 22 into a fluid pocket or pockets 23. During operation fluid is led into thrust chambers 21. Thrust chambers 21 may be located opposite diametrically to the entrance flow passage 17 or laterally distanced therefrom. For example, as shown in FIG. 4. The fluid, led into the thrust chambers 21 may be lubrication oil or gas. The pressure may be supplied by an external pumping source or pressure source or by communication with the fluid pressure in the cylinder 11. The cross-sectional area of thrust body 22 or of all of them in the sum, is so calculated, that the force excerted by it against the valve 3 is alltimes oppositionally directed against the pressure in cylinder 11 and in flow passage 17 but alltimes a little bit higher than the force out of passage 17 against the valve 3. Thus, under all conditions the valve body 3 remains pressed against the sealing surface portion of the valve head 9 and thereby the valve closes the cylinder perfectly, when revolved into into its closing position as shown in FIG. 5.

Figure 7:
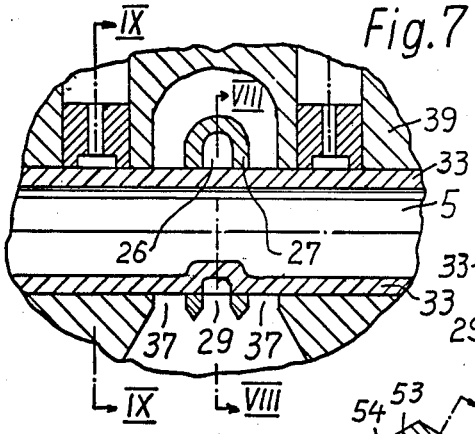
FIG. 7 is an alternative to FIG. 4 in equal view.
Figure 8:
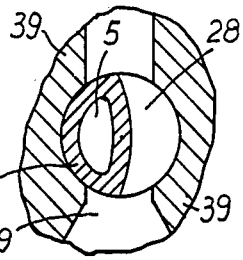
FIG. 8 is a cross-sectional view through FIG. 7 along VIII—VIII.
Figure 9:
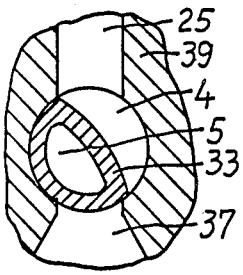
FIG. 9 is a cross-sectional view through FIG. 7 along IX—IX.

In FIGS. 7 to 9 an alternative to valve 3 of FIGS. 1,4,5,6 is demonstrated. In FIGS. 7 to 9 the cylinder head has two or three, in short a plurality of inlet und flow ports or passages. Namely inlet ports 25 and 26 and passages 29 and 37. One port and one of the passages is for inlet of pure compressed air. The other may be for inlet or fuel-air mixture. Respectively the valve 33 has two different inlet openings, namely 28 and 4.

FIG. 8 shows the inlet opening 28 in the opened position. Fresh compressed air flows for example from a loader air compressor 67 of FIG. 12 through exit port 68 of FIG. 12 into inlet port 26 of FIG. 8, therefrom through valve inlet opening 28 into flow passage 29 and therefrom into the cylinder 11. It presses all residue of old burned gases from the earlier working stroke out of cylinder 11. When this procedure is completed, the valve 33 has in the meanwhile continued its revolving. Port 28 now closes and inlet opening 4 of FIG. 9 begins to open. The fluid-fuel mixture now flows for example from the respective loader or from fuel-mixture compressor 65 of FIG. 12 through exit port 69 into the entrance port 25 of FIG. 9. Therefrom the air fuel mixture flows through the valve opening 4 into the flow passage 37 and therefrom into the cylinder 11. As soon as the cylinder is filled with the fuel-air mixture, the outlets slots 1 are closed by the piston 19. The piston then compresses the mixture in the cylinder, because at about same time, when the slots 1 are closing, the inlet opening 4 closes also, because the valve 33 continues the rotation. Thus, when the outlet slots 1 are closed, the inlet valve openings 28 and 4 are also closed. The piston now continues to do its compression stroke, until about an uppermost position the ignition plug or plugs are firing, the mixture burns and thereafter the expansion or working stroke occurres, when the piston 19 moves downward again, until the outlet slots 1 open and the expanded gases exhaust outwards through the slots 1 and the collection chamber 2. The cycle is completed.

The engine, thus has given one complete working cycle at a single revolution of the crankshaft. The power is thereby substantially doubled compared to the four stroke engine. It is not exactly doubled, because the slots 1 of the invention take a portion of the compression and expansion stroke away compared to four stroke engines. The slots 1 of the invention extend however only over a small portion of the piston stroke, for example 10 to 20 percent. Thus, the power of the engine increases to about 1.6 to 1.9 over the power of the common four stroke engine.

Since it is one object of the invention, to eliminate the hot exhaust valve of the common four stroke engine, the invention obtained free space in the cylinder head, which can, in accordance with the invention be utilized to set a second inlet valve into the cylinder head. Such possibility is demonstrated in FIG. 1. On the left side of cylinder head 9 we see the second inlet valve 3 with second inlet opening 4 in valve 3. Overflow passage 15 communicates inlet port 84 not only to inlet opening 4 of the right inlet valve 3, but also to the second, the left inlet valve 3 and thereby to both openings 4 of both valves 3.

By this provision of the invention the inlet flow through cross-sectional area is doubled compared to common four stroke engines, whereby the engines can run at higher rpm, because almost double the amount of air or fuel-air mixture can now be led into the cylinder 11 in accordance with the invention. Namely 1.6 to 1.9 times more than in the common four stroke engine.

Thus, the power is not only almost doubled compared to four stroke engines by providing double working strokes per equal crankshaft revolution, but the power is again almost doubled by provision of double inlet area by the invention. Thus, the engine can revolve with higher rpm than the common four stroke engine. In short, the power of the engine of the invention can become increased almost 3.5 times over the power of a common four stroke engine of equal size. At same time the weight is reduced, because the rotary valves 3 need less weight, than the common cam-shaft assembly with axially moving valves of common four stroke engines.

Cover 16 provides a good guide for ram air through the spaces between ribs 15 of the valve head for cooling the valve head effectively when the engine moves foreward in a car, motorbike or in an aircraft or like. Cylinder ribs 14 are common cooling ribs. Instead of air-cooling as shown in the figures, the engine can also use water cooling.

Instead of providing rotary valve 3 in the cylinder head it is also possible to leave the common inlet valve in the cylinder head. In such case only the cam shaft has to be modified, in order to provide one opening of the inlet valve at one rotation of the crankshaft. This can also be achieved by providing the common camshaft with equal revolution as the crankshaft. The camshaft in an engine of common type revolves only with half of the rpm of the crankshaft. Thus, just by changing the drive gear, for example sprocket, a common four stroke engine can be converted into an engine of the invention. Just the rocker arms for driving the outlet valves are taken off. Then the common outlet valve remains closed at all times. The cylinder block of the common engine becomes replaced by one of the invention, and the common four stroke eingine has obtained the increased power by these means of the invention. Naturally the charger, for example, 69 has to be added. Thus, by the means of the invention, the take off power of common aircraft engines can be multiplied by the small modifications, as described above. The above at hand of the sample of FIGS. 7 to 8 described timely distanced supply of air and later of fuel-air mixture into cylinder 11 is done in order to prevent any escape of fuel-air mixture through the outlet slots 1 of the invention. This provision overcomes the trouble of common two stroke engines, where fuel-air mixture can timewise escape from the outlet slots. Thus, the invention prevents the efficiency losses of common two-stroke engines. Instead of sending the different gases timely distanced into the cylinder, it would also be possible to send the air to one of both inlet valves 3 into cylinder 11 of figure one and the air mixture therafter through the other inlet valve 3 of FIG. 3. In such case separated inlet ports have to be provided in the valve head. For example one on the right side, as 84 in FIG. 1 and another on the left side.

To provide two different flows of gases, for example, one flow of pure air and another flow of air-fuel mixture, the turbocharger of FIG. 12 of the invention differs from the common turbocharger insofar as shaft 72 is elongated, a second compressor rotor 67 is mounted on the elongated shaft and a respective additional housing portion with exit port 68 is provided. The described means prevent escape of air-fuel mixture through the exhaust ports 1 of the invention and thereby prevent losses of fuel and increase or provide a good efficiency and fuel economy of the invention.

A further difficulty of common four stroke engines is, that the exhaust pipes go in forward direction of the engine. That prevents a good cooling air flow to the engine's cylinders and valve head and also it heats the cooling air up before the cooling air reaches the ribs, which it should cool. The exhaust collection chamber 2 of the invention exhausts all hot exhaust gases to the end of the engine directly into entrance port 70 of the turbocharger of FIG. 12 or of any common turbocharger. This spares the heretofore used long pipes from the front of the engine to the turbocharger in the back of the engine of motorcycles and other vehicles. But in addition, since the forward hot exhaust pipes are prevented by this this invention, there is not nothing left, which could disturb the flow of good cooling cool air to the cooling ribs of the engine. Thus, the cooling of the engine is effectively increased by the provision of the means of this invention.

A further feature of the engine of the invention is, that at times of required high power, the engine can run with 3,5 times of the power of the common four stroke engine at same weight of the engine or at even little less weight.

But, that is not all. Because the engine of the invention may over longer time operate with more fuel economy than the common four stroke engine. For example, a vertical take off aircraft requires a very high power at vertical flight, like take off and landing. But at forward flight it uses only a fraction of the take off power. At such foreward flight the aircraft will fly much longer than at the short time of vertical take off or landing. The long forward flight, thus, desires fuel economy at our times of shortness of fuel. This can be obtained by the means of the invention. For example by running the engine with a high over air ratio "lambda". Common engines run with "lambda"=about 1, which means with so much fuel, that it just burnes in the air. The fuel is just the stochimetric value needed to burn the respective amount of fuel in the respective amount of air. But in fuel economic operation, a high over air ratio, for example two or mor times, than lambda=1 the thermal efficiency of the engine increases. That results in less power, but in less fuel consumption per used HP too. Such fuel economy is highly desired. In the common four stroke engine it was difficult to achieve this desired fuel econly, because the benefit in thermal efficiency would be eaten away again by the bigger friction losses at only one working stroke at two crankshaft revolutions. But, the engine of the invention has only two strokes per one power stroke. Thus, it has only half of the friction valves, piston on cylinder wall, crankshaft bearings and like. The sum of friction per power stroke reduced, the engine leaves the possibility of using a higher air ratio lambda. Because much less friction of the engine per power stroke takes much less friction losses away from the power stroke, than a conventional four stroke engine does. Thus, the engine obtains at higher air ratio "lambda" a better total efficiency than the common four stroke engine.

Figure 10:
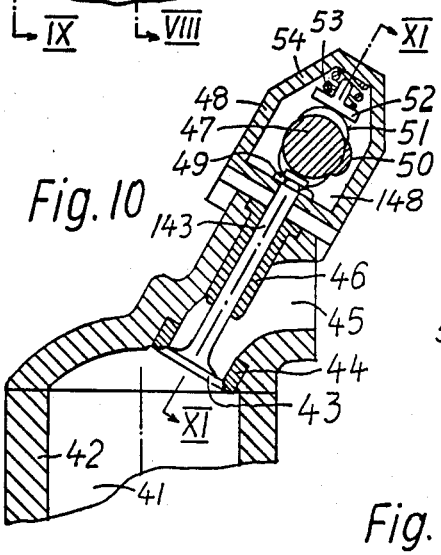
FIG. 10 is a longitudinal sectional view through another embodiment of the invention.
Figure 11:
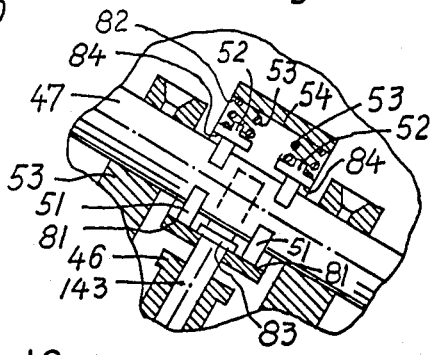
FIG. 11 is a cross-sectional view through FIG. 10 along XI—XI.

In FIGS. 10 and 11 an improved valve is shown, which can be used in the engine of this invention, but also in any common four stroke combustion engine.

The commonly used valves in common four stroke engines have the difficulty, that the valve is lifted against a strong spring set. The strong spring set closes the valves, at those times, when the valve is required to be closed and when not any action to open the valve by force is acting. The valve opener, for example cam shaft or cam shaft and rocker or bar, open the valve against the spring set in the full stroke of the respective valve. Thus, the common spring set of the valve in the common engine experiences a compression in the full extent of the valve stroke. This is a considerable compression length for a spring. It reduces the life time of the spring set and requires strong and long springs of best material and manufacturing. Said difficulty can be overcome by the means of FIGS. 10 and 11 of the invention.

The valve 43 is, as common in present day four stroke engines, borne on seat 44, when closed. It seals against the seal seat insert 4. From the back of the valve disc 43 extends in the known style the valve shaft 143 and said shaft 143 is guided in the guide bush 46 for the exail movement of the valve 43-143. The valve shaft 143 extends through the inlet port 45 in the known way. For opening of the valve a rocker or cam shaft pushes the valve 43-143 in the direction towards the cylinder, whereby the valve disc 43 opens away from the valve insert seat 44. Insofar the valve is common in four stroke engines and well known.

According to the invention however, the valve shaft 143 is much shorter, than in the common engine. That is, because according to this embodiment of the invention, the common spring is eliminated, since it was a most loaded and most endangered part of the common engine. Instead of the heretofore common spring, only the holder bottom of holder 48 is fastened to the valve stem or valve shaft by holding retainer 49. The holder 48 is hollow in order to make the insertion of a valve rocker or the insertion of a cam shaft through it possible. In the FIGS. 10 and 11 the camshaft 47 is extened through the hollow holder 48. The camshaft 47 has the generally known knock body portion 50, which, when the camshaft 47 is turned, thrust against the valve end and forces it downward for openeing from valve seat body 44. Such opening procedure for opening the valve is generally used. However, the commonly used valve stem or valve shaft 143 is much longer than in the valve of the invention because it includes a complete spring set between bush 46 and holder retainer 49. But in the invention, the distance from the valve guide bush 46 to the holding retainer means 49 is only very short. In fact, only slightly longer, than the valve opening stroke is. According to the invention, the holder 48 includes a top portion 54 opposite to the bottom portion of it. On top of the camshaft 47 or on top of a respective rocker arm is a small spring set 53 provided with a guide slide portion 52. Instead of one, there can be a pair or a plurality of these members as demonstrated in FIG. 11. The small spring set 53 of the invention is borne on one end the the slide guide member 52 and on the other end by the upper portion 54 of the holder 48. It is preferred to set the camshaft 47 sidewards of the valve stem 143 into bearings 55 wherein the cam shaft 47 can revolve. In the embodiment of FIGS. 10 and 11 there are two sets of small springs 53 and also two sets of slide members 52. Each one to each spring 53. The slide members 52 are pressed against the outer surface of the camshaft by springs 53. The cam shaft of this embodiment of the FIGS. 10 and 11 has laterally distanced a little from the main knock body portion or thrust portion 50 are rather oppositionally located upwards thrust body configurations 51 provided on the cam shaft 47. They extend over a much wider angle around the camshaft 47 than the downward thrust-portion 50 does. The said upward thrust configuration body portions 50 are lifting the valve 43-143 upwards to close it on valve seat 44 by pressing against the upper portion 54 of holder 48. Opposite diametrically to the downward thrust-portion 50 are no upward thrust portions 51. Thus, the upward and downward thrust portions 50 and 51 co-operate together inside the hollow holding member 48 to move the valve 43,143 upwards to close and downward to open the relation to the rotation of the cam shaft and of the crankshaft or move of the piston of the engine. If the inner configuration of holder 48 is exactly machined to match the radii of thrust portions 50 and 51 of the camshaft, there would not be any need for spring sets 53. The camshaft would just rotate around in the hollow holder 48 and thereby move the valve 43 up and down for open and close, as desired in the engine. In order however, to allow a small machining mistake in the inner configuration of the holder 48, the valve set including the slide portion, namely 53 and 52 can be incorporated into the interior of the holder 48. It is thus left up to the designer's choice, either to use spring sets 53 and slide bodies 52 inside the hollow holder 48 or likewise to broach the inner configuration of the holder 48 exactly and let the thrust configurations 50 and 51 slide along the respective inner face portions of the bottom and of the top of holder member 48.

When the spring set(s) 53,52 is (are) provided, a good closing of the valve disc 43 on the valve seat 44 is assured by the force of said spring et 53,52. The spring set 53 does almost not any expansion or contraction work in this invention. It is almost stationary in rest respective to its own compression and expansion. It only maintains a force against the valve 43-143. It keeps it close on the seat 44. It moves together with the entire valve up and down during valve-operation. The spring deflection is therefore so very small, that the life time of the spring is increased many times compared to the valve springs of common four stroke engines and also the spring is much shorter and of much less weight, than the springs of the common engines are.

Thus, the reduction of spring deflection, the reduction of weight and the more reliable structure provides a valve means of higher reliability and of higher life, than the common valves of four stroke engines of today. Therefore, the valve assembly of the embodiment of FIGS. 10 and 11 of the invention does not only increase the life time and reliability of the valve of the invention, but can equally increase the life, speed and reliability of valves in common four stroke engines, if applied in them as inlet or outlet valve means.

Since the valve of said figures is shorter and the entire valve-spring set weight is less than in the common four stroke engine, the valve set of the invention can operate with higher cycles, which means with higher rpm and can thereby increase the power of engines whereto it will be applied and at same time slightly even reduce the weight of such engines.

The figures demonstrate only samples and embodiments of the invention. Any suitable modification falls within the scope of the invention, provided that it serves equal purposes as described in this invention. The invention may not only be applied to crankshaft operated piston engines but also to free piston engines or to hydraulically operated piston engines, for example as in my patents U.S. Pat. Nos. 2,260,213 or 3,269,321.

Figure 16:
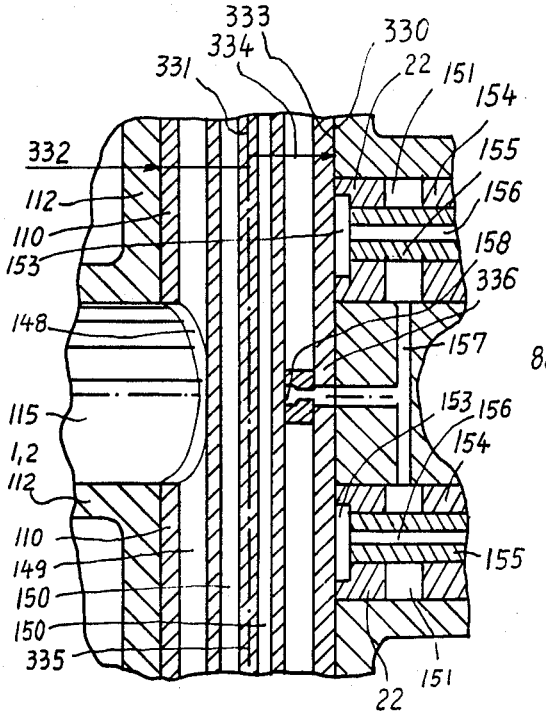

FIG. 16 shows a preferred rotary valve of the invention assembled into a cylinder head 112. Rotary valve 110 revolves closely fitting in a respective bore in cylinder head 112. It has a passage or port 148 for the supply of gas into or out of cylinder chamber 115. Port 148 leads the gas into or out of gas passage 149. The rotary valve 110 also has cooling fluid passages 150. Under the load from pressure in cylinder chamber 115 the valve 110 would be pressed on the other side of its outer face against the face of the bore in the cylinder head, wherein the valve 110 revolves. That would lead to friction and wear. To prevent such friction and wear, the cylinder head is diametrically of the cylinder chamber 115 relative to the rotary valve provided with recesses or rooms 151. They are axially distanced from the port and chamber 148 and 115. It is preferred to set two chambers or rooms 151 per port 148 or per cylinder chamber 115. A thrust piston 152 is radially moveably inserted into the respective room 151. On the inner end it has a slide face with a radius complementary to the radius of the outer face of rotary valve 110. A fluid pressure pocket 153 extends from the said face into the thrust body 152. The chamber 151 is closed in the other radial direction be closing body 154. The gas or pressure of the gas in cylinder chamber 115 is now led through passage 158 through the rotary valve 110 or through the cylinder head 112 into passage 157 and from this passage into the room or rooms 151. The pressure of the chamber 115 is now present in room 151 and presses the respective thrust body 152 against the outer face of the rotary valve 110. The direction of pressing is counter directed relatively to the pressure from cylinder chamber 115 against the rotary valve 110. It is preferred to make the sum of the half sealing lands around the pockets 153 and the pockets 153 equal to the area with which the rotary valve 110 is subjected to pressure out of cylinder chamber 115. The valve 110 is then floating between oppositionally directed equal forces of pressure in fluid. Friction and danger of sticking is drastically reduced or almost fully eliminated.

In order to prevent also here a mixing of the lubrication fluid with the gases of the cylinder chamber 115, a passage body 155 may extend from closure 154 through rooms 151 and through thrust body 152. It may closely fit in thrust body 152 but permit relative movement between body 155 and 152. A passage 156 extends then through the passage body 155 to lead lubrication fluid from a supply source into the pocket(s) 152. Since passage body 155 seals by close fit in thrust body 152, any mixing of gas of cylinder 115 and lubrication fluid is prevented. A respective control device should adjust the pressure in lubrication fluid in passage(s) 156 and pocket(s) 153 to be substantially equal or close to that pressure which is at that moment acting in the respective cylinder chamber 115.

Figure 14:
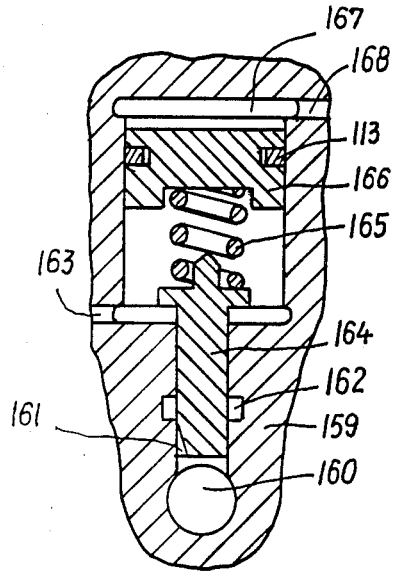
FIG. 14 is a sectional view through a flow separation valve arrangement.

FIG. 14 is a longitudinal sectional view through an automatic control device of my invention. Housing 159 has a lubrication fluid inlet 160 and a seat for a valve 164. Valve 164 is axially moveable in its fit in housing 159. On one end the valve 164 is subjected to the fluid pressure in inlet 160 and on the other end to the force of a compression spring 165. When the pressure in inlet 160 is stronger in force than the force of spring 165, the valve 164 moves and opens for example by notch 161 the inlet 160 to an outlet 162. The spring 165 is provided in valve chamber 167 wherein a piston 166 is axially moveable and sealed by piston rings or other seals 113. The spring 165 is borne with one end on one end of piston 166. The chamber between the bottom of piston 166 and valve 164 is open to neutral pressure by passage 163. Instead of neutral athmospheric pressure any other pressure may be provided, if so desired. On the top end, which is the other end of piston 166 the chamber 167 is communicated by passage 168 to another pressure source, for example to the cylinder chamber 15.

There are now two forces acting on the valve 165. From one end the force of pressure in inlet 160 which may bring the lubrication fluid. With increase of pressure in chamber 115 and thereby in room 167 in the valve, which now is gas-pressure of the engine, the piston 166 moves towards valve 164 and compresses the spring 165 stronger. It moves oppositely directed when the pressure in the combustion, expansion or compression cylinder chamber 115 is decreasing whereby it then softens the spring force of spring 165. Consequently higher pressure in room 167 sets the opening of valve 164 of inlet 160 to the outlet 162 at a higher pressure. Consequentely, the device of FIG. 14, when communicated by passage 168 to the respective cylinder chamber varies the pressure in the lubrication fluid supply line 160 parallel or equal to the pressure in the cylinder chamber 115. The pressure in the lubrication fluid in the pockets of the engine, pump or compressor now varies parallel or equal to the pressure in the gas in the respective cylinder chamber 115, when passage 168 is communicated to cylinder chamber 115 and fluid supply line 160 is communicated to the passages to the pockets in the engine, pump or compressor. The valve set of this figure may also be applied for other purposes with other communications.

Figure 15:
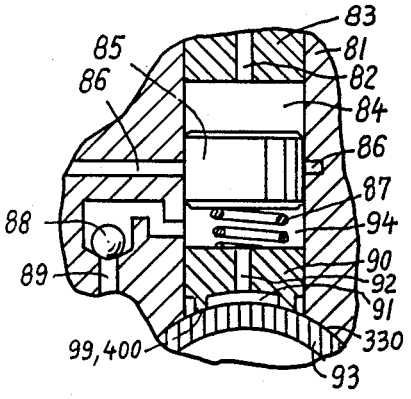
FIG. 15 is also a sectional view through a flow separation valve arrangement, and, FIG. 16 is a longitudinal sectional view through a rotary valve arrangement.

FIG. 15 shows a longitudinal sectional view through an automatically acting overflow valve. This valve is preferred to be used in machines which use gases as an operating fluid and liquids or other gases as a lubrication fluid. For example, in a combustion engine air or burned gases are used, to operate the device or to be handled in the device. Such gases are commonly not good for sealing and/or lubrication. Liquids, for example, oil, are better for such lubrication and/or sealing purposes. But on the other hand, the periodically changing pressures in the operating gases are required for balancing purposes in some devices of my invention(s). The operation fluids and the lubrication fluids should not mix with one another. Body 81 of the valve of this embodiment of the invention therefore has a chamber 84 with two axially moveable bodies 85 and 90 therein. The first body 90 is a thrust body and it is subjected to the lubrication fluid in chamber 94. The lubrication fluid, which may also act as a sealing fluid, is led from a supply source through passage 89 which should mostly contain a one way check valve 88 into the first chamber 94. This lubrication fluid presses from chamber 94 the thrust piston 90 against the face of the means to be sealed, for example, against body 93. The working gas pressure is led from the working place, for example from the compression or expansion cylinder of a gas-handling device into the chamber 84. Body 83 may close chamber 84 in the outward direction. The gas or fluid may be passed through passage 82 into chamber 84. Thrust body 90 may be provided with a passage 92 to communicate the chamber 94 with a fluid pressure pocket 91 in the other end of thrust body 90. A sealing land (or lands) surround(s) the pocket 91 to prevent escape of sealing fluid thereout. The sealing land is complementary configurated respective to the seal face of the body, for example 93, wherealong it shall seal and thrust. The sealing fluid which is led through passage 89 into chamber 94 and into fluid pressure pocket 91 acts therefore with a respective pressure in pocket 91. This pressure would however likely be the constant pressure of the supply arrangement. But the gas pressure would change periodically often drastically and quickly. The valve of the invention is therefore provided with an overflow arrangement which is a chamber 86 with an outlet 86. When the seal fluid pressure become periodically higher than the gas pressure, the separation piston 85 moves upwards in chamber 84 and opens chamber 94 to exit chamber 86. The seal fluid flows along the bottom of piston 85, which separates the both fluids, into the outflow or overflow arrangement 86. As soon as the gas pressure in chamber 84 becomes higher, the seal piston 85 moves downward again and closes the overflow chamber 86, whereby chamber 94 is closed again. The arrangement may for example, be used for sealing of the arrangements of the invention, for example of rotary valves, pistons or piston shoes of the combustion engines and like of the application. It perfectly supplies the pressure of the gases into the seal fluid containing fluid pressure pockets.

Figure 13:
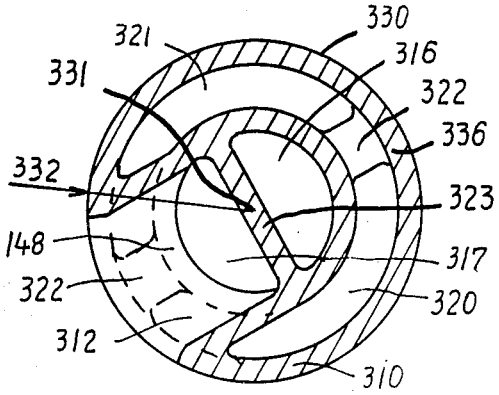
FIG. 13 is a cross-sectional view through a rotary valve.

FIG. 13 is a cross-sectional view through a sample of a rotary valve member of the invention, shown here in a larger scale. Valve member 310 has the cylindrical outer face 330 of the second radius 332 around the second axis 331. The second axis and the second radius 331 and 332 as well as the outer face 330 are also demonstrated in FIG. 12. FIG. 12 also shows the inner face 333 of the first radius 334 around the axis 335. These are coinciding in FIG. 12, because in FIG. 12 the rotary valve member 110 (310) is assembled into the bed of the valve-bearing body 112 (12).

Seen in FIG. 13 is the transfer passage 312 which extends from the axially extending passage 317 through a portion of the rotary valve member 310 and through the outer face 330 to periodically at rotation communicate and discommunicate with the transfer channel 115 of the valve-bearing body 112, which commonly is the cylinder head or valve head of the combustion engine, pump, motor or compressor, while the transfer channel 115 commonly extends to a cylinder or working chamber in cylinder- or chamber-body 1,2. See FIG. 12.

Passage 316 may be a flow-return passage and passages 320, 321 may be cooling passages, through which a cooling fluid flow may be led, for example the cooling flow supplied from the turbo-charger of FIG. 12. The fuel-air-mixture flow from the other compression stage of the mentioned turbo-charger or super-charger may then flow through passage 317. Eventually the exhaust flow may flow through passage 316.

While the invention has herebefore been described in generally understandable terms of technology, in the following the invention will be described in more specific terms of technology in order to define the geometrical relationships more accurately and in order to make locations and parts more definable in different terms, to make the functions and relationships more clear. In the following summarily definition of the invention, different terms of technology will partially be used than were used in the general description herebefore.

SUMMARILY AND IN DETAIL

The invention provides the following:

(a) A valve arrangement including a rotary valve member 110,310 with a cylindrical outer face 330 provided in a valve-bearing body 9,112;

wherein said body includes a valve-bearing bed 333 of hollow cylindrical configuration with a cylindrical inner face 333 of a constant radius 334 about a longitudinal first axis 335;

wherein said valve member has a longitudinal second axis 331 and the cylindrical outer face of said member is formed by a second radius 332 around said second axis 331;

wherein said valve member is located in said bearing bed 333 and able to revolve in said bed around said second axis;

wherein said second axis coincides with said first axis when said member is inserted into said bed, wherein said second radius is substantially equal to said first radius, but very slightly shorter than said first radius to provide a narrow clearance between said outer face and said inner face;

wherein said valve-bearing body is provided with an entrance port wherein said rotary valve member is provided with at least one axially longitudinally extending passage 149,150,5, in said member;

wherein said member is provided with at least one inlet passage 5,149,84 and at least one transfer passage 148, while said inlet passage and said transfer passages port into and from said axially extending passage 149,5;

wherein said inlet passage is axially respectively to said second axis distanced from said transfer passage and said transfer passage extends from said axially extending passage radially through a portion of said member and through said outer face of said member, wherein said valve-bearing body is provided with at least one transfer-channel 17,115 which is axially relatively to said second axis located substantially radially of said transfer passage of said rotary valve member to periodically communicate and discommunicate with said transfer passage of said member, when said rotary valve member revolves in said bed of said valve-bearing body;

wherein pockets 21,23,151,153,84,91 are provided in said body;

wherein at least one pair of pockets 21,23,151,153,84,91 is provided in said body, while said pockets are open towards said outer face of said member, wherein one of said pockets is relatively to said axes axially distanced in one axial direction from said transfer passage while the other pocket of said pair of pockets is distanced from said transfer passage in the other axial direction relatively to said axes, wherein said pockets are distanced substantially in equal lengthes but oppositional axial directions from said transfer passage;

wherein said pockets are radially relatively to said axes diametrically oppositionally located relatively to said transfer channel;

wherein the clearance between said inner face and said outer face forms sealing lands around said transfer channel and around said pockets;

wherein said pockets are subjected to pressure in fluid and filled with fluid;

wherein said pressure in said fluid in said pockets extends in them gradually decreasing into said sealing lands around said pockets and the channel fluid pressure in said passage channel extends in it gradually decreasing into said sealing land around said transfer channel; whereby said pressures in said sealing lands form mean value areas of pressure zones with pressures equal to said pressures in said pockets and in said transfer channel; and;

wherein the sum of the cross-sectional areas of the pressure zones of said pockets multiplied with the pressure therein corresponds substantially to the cross-sectional area of the pressure zone of said transfer channel multiplied by the pressure therein;

whereby said rotary valve member revolves in said bed of said valve bearing body substantially floating between said zones; and;

whereby said rotary valve member is substantially free of resulting radial forces to permit it to revolve substantially without friction between said inner face and said outer face, but to revolve instead between the fluids and pressures in said zones.

(b) The arrangement of (a), wherein said body is provided with substantially radial spaces 21,84,94, wherein axially moveable elements 90,22 are provided in said spaces to seal therein and to be able to move axially therein, wherein said spaces are communicated to a source of fluid under pressure, whereby said pressure acts onto the tops of said elements;

wherein said elements form bottom portions with seal faces 400 of said second radii around said second axis to slide along portions of said outer face, when said member revolves;

wherein said pockets are provided in said bottoms of said elements open towards said outer face, while said pockets are communicated to said spaces to filled with fluid and presssure from said spaces; and, wherein said bottoms form said sealing lands and zones of said pockets, while said elements are softly pressed by said pressure in said fluid in said spaces towards the respective portions of said outer face of said rotary valve member, whereby said rotary valve member floats between the said pressure zone of said transfer channel of said valve-bearing body and said pressure zones of said pockets of said bottoms of said elelements.

(c) The arrangement of (b), wherein said spaces are communicated at least indirectly to said transfer-channel 148,17, to transfer the pressure which is present in said channel into said spaces and thereby to equalize the pressures in said channel and in said spaces.

(d) The arrangement of (a), wherein a multiple fluids separation valve arrangement of FIG. 14 or 15 is communicated to said transfer channel and to said pockets;

wherein said pockets are communicated to a second fluid which is different from the first fluid in said transfer channel; and;

wherein said separation valve arrangements separates said second fluid from said first fluid, but controls the pressure in said pockets to maintain at all times at least periodically a parallelity of the rates of pressure in said fluids in said channel 17,115 and in said pockets 23,153,91.

(e) A valve arrangement including a rotary valve 3,110,310 with a cylindrical outer face 330 provided in a valve-bearing body 9,112;

wherein said body includes a valve-bearing bed 333 of a hollow cylindrical configuration with a cylindrical inner face 333 of a constant radius 334 about a longitudinal first axis 335 wherein said valve member has a longitudinal second axis 331 and the cylindrical outer face of said member is formed by a second radius 332 around said second axis, wherein said valve member is located in said bearing bed and above to revolve in said bed around said second axis;

wherein said second axis coincides with said first axis when said member is inserted into said bed, wherein said second radius is substantially equal to said first radius, but very slightly shorter than said first radius to provide a narrow clearance between said outer face and said inner face;

wherein said valve-bearing body is provided with an entrance port wherein said rotary valve member is provided with at least one axially longitudinally extending passage 316,317,149,150,5 in said member;

wherein said member is provided with at least one inlet passage and at least one transfer passage 4,148,312 while said inlet passage and said transfer passages port into and from said axially extending passage; for example, 148 from 149 or 312 from 317;

wherein said inlet passage is axially respectively to said second axis distanced from said transfer passage and said transfer passage extends from said axially extending passage radially through a portion of said member and through said outer face of said member, wherein said valve-bearing body is provided with at least one transfer-channel which is axially relatively to said second axis located substantially radially of said transfer passage of said rotary valve member to periodically communicate and discommunicate with said transfer passage of said member, when said rotary valve member revolves in said bed of said valve-bearing body;

wherein said body is provided with substantially radial spaces 21,151,84,94;

wherein axially moveable elements 22,90 are provided in said spaces to seal therein and to be able to move axially therein, wherein said spaces are communicated to a source of fluid under pressure, whereby said pressure acts onto the tops of said elements;

wherein said elements form bottom portions with seal faces 400 of said second radii around said second axis to slide along portions of said outer face, when said member revolves;

whereby said rotary valve member floats between the pressure in said transfer channel of said valve-bearing body and said pockets and seal faces of said bottoms of said elements.

(f) A reciprocating combustion engine including substantially a structure of a cylinder 12, a piston 19 reciprocating in said cylinder, a top 9 for closing one end of said cylinder; inlet means 84,15 and outlet means 1 extending to and from said cylinder for the intake of a combustible gas charge and the expellation of burned exhaust gases, ignition means for the ignition of said gas charge, cooling means 14,6,7 applied on said cylinder and on said top, a turbine of a turbocharger 60 communicated to said outlet means and a compressor of said turbo charger communicated to said inlet means, said outlet means formed by slots 1 in the bottom portion of said cylinder and said inlet means are applied in said top, said gas charge including air, said air being pressed through said inlet means into said cylinder by said compressor, at least one second cylinder fastened relatively to said cylinder, a second piston reciprocating in said second cylinder, a common drive means attached to said piston and said second piston for driving said pistons to compression strokes in said cylinders at alternating times, said second cylinder including second outlet means communicated also to said turbine, said top includes second inlet means communicating with said second cylinder and said compressor, wherein said inlet means includes at least one rotary valve (valve member) 3,110,310 and inlet ports, also called: "transfer passages," between said valve and said cylinders, wherein said rotary valve is borne in a valve-bed 333,6,7, in said top 9,112;

wherein said valve includes inlet passages 4,148 to open said inlet ports, wherein said valve includes closing portions 336 for closing said inlet ports to said cylinders, wherein said inlet means includes pairs of fluid pressure balancing recesses, also called: "pockets", 23,153,91 diametrically located relatively to said inlet ports 17,115, opposite of said valve in said top, wherein said valve is subjected to said fluid pressure recesses, wherein said fluid pressure recesses have a sum of cross-sectional area substantially corresponding to the cross-sectional area of the respective inlet port(s) 17,115, wherein one recess of the respective pair of said recesses is distanced from the respective inlet passage in one axial direction, wherein the other recess of the respective pair of said recesses is distanced from said inlet passage in the other axial direction, wherein said axial directions are defined by the axis of said valve and wherein said fluid under pressure is supplied into said recesses for counter acting forces of fluid under pressure in said inlet passage and thereby provides an easy rotation of said valve with a reduced friction between said valve and said valve-bed.

(g) A reciprocating combustion engine including substantially a structure of a cylinder 12, a piston 19 reciprocating in said cylinder, a top 9, for closing one end of said cylinder inlet means 15,84 and outlet means 1 extending to and from said cylinder for the intake of a combustible gas charge and the expellation of burned exhaust gases, ignition means for the ignition of said gas charge, cooling means 14,6,7 applied on said cylinder and on said top, a turbine of a turbocharger 60 communicated to said outlet means and a compressor of said turbo charger communicated to said inlet means, said outlet means formed by slots 1 in the bottom portion of said cylinder and said inlet means are applied in said top, said gas charge including air, said air being pressed through said inlet means into said cylinder by said compressor, at least one second cylinder fastened relatively to said cylinder, a second piston reciproating in said second cylinder, a common drive means attached to said piston and said second piston for driving said pistons to compression strokes in said cylinders at alternating times, said second cylinder including second outlet means communicated also to said turbine, said top includes second inlet means communicating with said second cylinder and said compressor, wherein a common collection chamber 15 is provided in said top, communicated to said inlet means of said cylinders and to said compressor and attached to said cooling means of said top for the cooling of said air, when said exhaust gases drive said turbine and said compressor presses at least said air through said common collection chamber and said inlet means into the said cylinders.

wherein said inlet means includes at least one rotary valve 3,110,310 and inlet ports, also called "transfer passages", between said valve and said cylinders, wherein said valve is borne in a valve-bed 6,9,333 of top 9 or of body 112, wherein said valve includes inlet passages 4,148 to open said inlet ports, wherein said valve includes closing portions 336 for closing said inlet ports, wherein said inlet means includes pairs of fluid pressure balancing recesses (pockets) 23,153,91 diametrically located relatively to said inlet ports 17,115 opposite of said valve in said top, wherein one recess of the respective pair of said recesses is distanced from said inlet passage in one axial direction, wherein the other recess of the respective pair of said recesses is distanced from said inlet passage in the other achsial direction, wherein said axial directions are defined by the axis of said valve, wherein fluid under pressure is supplied into said recesses, wherein said recesses are communicated to the respective cylinders, wherein the pressure in said fluid in said recesses alternates in unison with the pressure of said gases in the respective cylinder, whereby forces of pressure in fluid in said inlet passages are balanced by forces of pressure in fluid in said recesses for providing a floating rotation of said valve in said bed with reduced friction.

(h) A reciprocating combustion engine including substantially a structure of a cylinder 12, a piston 19 reciprocating in said cylinder, a top 9, for closing one nd of said cylinder; inlet means 15,84 and outlet means 1 extending to and from said cylinder for the intake of a combustible gas charge and the expellation of burned exhaust gases, ignition means for the ignition of said gas charge, cooling means 14,6,7 applied on said cylinder and on said top, a turbine of a turbocharger 60 communicated to said outlet means and a compressor of said turbo charger communicated to said inlet means, said outlet means formed by slots 1 in the bottom portion of said cylinder and said inlet means are applied in said top, said gas charge including air, said air being pressed through said inlet means into said cylinder by said compressor, at least one second cylinder fastened relatively to said cylinder, a second piston reciproating in said second cylinder, a common drive means attached to said piston and said second piston for driving said pistons to compression strokes in said cylinders at alternating times, said second cylinder including second outlet means communicated also to said turbine, said top includes second inlet means communicating with said second cylinder and said compressor, wherein a common collection chamber 15 is provided in said top, communicated to said inlet means of said cylinders and to said compressor and attached to said cooling means of said top for the cooling of said air, when said exhaust gases drive said turbine and said compressor presses at least said air through said common collection chamber and said inlet means into the said cylinders.

wherein said inlet means includes at least two rotary valves 3,110,310,93 and inlet ports 17,115 between said valves and said cylinders, wherein said valves are borne in valve-beds 333,9,112 in said top 9,112;

wherein said valves include inlet passages 4,148 to open said inlet ports, wherein said valves include closing portions 336 for closing said inlet ports, wherein said inlet means include pairs of fluid pressure balancing recesses (pockets) 23,153,91 diametrically located relatively to said inlet ports 17,115 opposite of said valve in said top, wherein one recess of the respective pair of said recesses is distanced from said inlet passage in one axial direction, wherein the other recess of the respective pair of said recessses is distanced from said inlet passage in the other axial direction, wherein said axial directions are defined by the axis of said valve, wherein fluid under pressure is supplied into said recesses, wherein said recesses are communicated to the respective cylinders, wherein the pressure in said fluid in said recesses alternates in unison with the pressure of said gases in the respective cylinder, whereby forces of pressure in fluid in said inlet passages are balanced by forces of pressure in fluid in said recesses for roviding a floating rotation of said valve in said bed with reduced friction, wherein said valves are driven in unison by said common drive means and wherein said collection chamber is a common collection chamber relatively to said valves and extending to said at least two valves to guide at least said air to said inlet pasages and to cool said valves by said cooled gas in said collection chamber.

(i) A reciprocating combustion engine including substantially a structure of a cylinder, a piston reciprocating in said cylinder, a top for closing one end of said cylinder, inlet means and outlet means extending to and from said cylinder for the intake of gas and the expellation of exhaust gases, air in said gas, provisions to add fuel to said air to provide a combustible gas, ignition provisions to ignite said combustible gas, cooling faces applied to said cylinder and to said top, wherein said means include at least one rotary valve 3,110,310 (value-member) and at least one inlet port(s) 17,115 between said valve and said cylinders, wherein said rotary valve is borne in a valve bed 333,9,112 said top 9,112, wherein said valve includes at least inlet passage(s) 4,148 to open said inlet port(s), wherein said valve includes closing portions 336 for closing said inlet ports to said cylinders, wherein said inlet means includes pairs of fluid pressure balancing recesses (pockets) 23,153,91 diametrically located relatively to said inlet passages opposite of said valve in said top, wherein one recess of the respective pair of said recesses is distanced from the respective inlet passage(s) in one axial direction, wherein the other recess of the respective pair of said recesses is distanced from said inlet passage in the other axial direction, wherein said axial directions are defined by the axis of said valve and wherein fluid under pressure is supplied into said recesses for counter acting forces of fluid under pressure in said inlet passage and thereby providing an easy rotation of said valve with a reduced friction between said valve and said valve-bed.

(k) The arrangement of (d), wherein said separation valve arrangement includes a valve housing 159 with a therein provided space 167 withe a therein axially movable element (control piston) 166;

wherein said housing is provided with a reception bore with a therein axially movable overflow piston 164;

wherein said space is divied by said piston element into a top-portion and a bottom portion, while said top portion is provided with a communication passage 168 and said bottom portion is provided with an intermediate passage 163;

wherein said reception bore extends from said bottom portion;

wherein an entrance passage 160 is provided on the opposite end of said reception bore, whereby said overflow piston is subjected on its top end to the pressure in said bottom portion of said space, while the bottom end of said overflow piston is subjected to the pressure in said entrance passage;

wherein a medial groove is provided in said housing around the medial portion of said overflow piston and communicated to a space under low pressure;

wherein said overflow piston has on its bottom end flow-through slots 161 with cross-ectional areas wider at said bottom portion of said overflow piston and narrower towards said medial portion of said overflow piston;

wherein said, communication passage is communicated to a first pressure, said intermediate passage is communicated to a second pressure and said entrance passage is communicated to a third pressure; and;

wherein a spring 165 is interposed between said element 166 and said top portion of said overflow piston 164;

whereby said element (control piston) 166 oscillates between said first and second pressures, while said overflow piston 164 oscillates between said second and third pressures.

(l) The arrangement of (k), wherein said communication passage 168 is communicated to a cylinder of an engine, said intermediate passe 163 is communicated to a neutral or zero pressure area and said entrance passage 160 is communicated to a source for supply of lubrication and seal fluid under pressure; and wherein said entrance passage 160 is also communicated to at least one fluid pressure pocket of said valve arrangement, whereby said element (control piston) 166 alternately compresses and decompresses said spring 165 in dependence on the pressure in said cylinder of said engine, while said overflow piston 164 controls the pressure of said lubrication and seal fluid substantially parallel in timed relation to said pressure in said cylinder to maintain substantially at all respective times at least a parallelity of rate of pressures in said cylinder and in said lubrication and seal fluid.

(m) The arrangement of (d), wherein said separation valve arrangement includes in a portion of a body a control cylinder 84 open at the first end thereof towards a portion of an outer face 333 of a moving member 93,3,110,310;

wherein a reciprocable control piston 85 is provided in said control cylinder 84;

wherein a thrust piston, also called: "element", 90 is provided axially of said control piston close to said first end of said control cylinder in said control cylinder, whereby a top chamber 84 appears in said control cylinder close to the second end thereof and on the top end of said control piston 85, while a bottom chamber 94 appears between said control piston 85 and said element 90 in said control cylinder;

wherein a spring 87 is interposed between said control piston 85 and said element 90;

wherein a medial collection groove 86 meets a medial portion of said control piston 85 and a second communication passage 86 extends from said medial groove;

wherein a first communication passage 82 extends from said top chamber 84;

wherein a third communication passage 89 extends from a fluid supply source of a third pressure into said bottom chamber 94 of said control cylinder;

wherein a one-way check valve 88 is provided in said third communication passage 89; and;

wherein said second communication passage 86 is communicated to a room under substantially low pressure, while said first communication passage is communicated to a room containing a second pressure;

whereby said control piston oscillates under said second and third pressures in said chambers 84 and 94 und under the force of said spring to open and close said second communication passage and to increase and decrease the volumes of said chambers, while said element (thrust piston) 90 is pressed with its bottom portion against a respective face 330 of said moving member 93,3,110,310.

(n) The arrangement of (m), wherein said moving member is a rotary valve 93,3,110,310 while said face is a cylindrical outer face 333 with said second radius 332 around said second axis 331;

wherein said thrust piston (element) 90 forms a slide face 99 on its bottom portion with said first radius 334 around said first axis 335; and wherein said slide face 99 is pressed against a portion of said outer face 333 of said rotary valve 93,3,310,110, whereby said rotary valve is pressed with a diametrically opposite portion of said outer face 333 against the respective transfer channel 17,115 to create and maintain a good sealing between said rotary valve and said transfer channel.

(o) The arrangement of (n), wherein said element (thrust piston) 90 is provided with a pocket 92 which is open towards and through said seal face 99 and communicated by a passage 91 to said bottom chamber 94;

wherein said first communication passage 82 is communicated to the working chamber (cylinder) 11 of a fluid operated (operating) engine (for example, combustion engine); and;

whereby lubrication and seal fluid is present in said pocket(s) 92,23,153 while said separation valve arrangement maintains a parallelity (or an equalness) of said pressures in said working chamber, for example 11, of said engine and in said pocket(s) substantially parallel in timed relation to the verifying pressure of the periodic cycles of pressure in said working chamber of said engine.

THEORY OF FUTURE APPEARANCES

In the specification I have herebefore described, that the rotary valve is floating between opposed but equally strong zones or fields of pressure in fluid. In therory this is in fact the ideal solution for bearing and guiding a rotary valve. At my works and researches in hydrostatic fluid motors and pumps, I have however gradually more and more realized, that ideal theoretical concepts and practical applications and solutions are not at all times coinciding with each other.

I believe to have found, that the ideal centric floating of a rotary member between opposed fields of fluid pressure is in fact the theoretically ideal solution, because it prevents every mechanical friction between relatibely to each other moving mechanical or bodily faces. However, the results of practical applications and researches, developments and testings in my laboratory indicate, that the mentioned ideal solution does not in all cases correspond to the practical results.

I have therefore come to the temporary conclusion, that the theoretical ideal solution of making a rotary member float between opposed fields or zones of pressure in fluid is a theoretically ideal, but in practice an instabile, labile, solution.

The mentioned instability is, that the floating rotary valve may freely depart from the concentric location within the bed and within the clearance between the inner face 333 of the bed and the outer face 330 of the rotary valve member to an eccentric location therein. That would occasionally result in an increased leakage of fluid through the then wider clearance portion. Because the leakage flows through the clearance with the third power of the radial size of the clearance. Such eccentric floating can therefore result in highly increased leakage.

I therefore assume, that in the future development my tendency will be to make the cross-sectional area of the thrust member or element slightly larger than the corresponding cross-sectional area of the transfer channel. The sealing lands are included in the calculations of the cross-sectional areas. Thereby I intend to obtain a narrow clearance along the transfer-channel(s) with a reduced leakage. The so to be obtained intentionally eccentric floating rotary valve will then be of smaller losses of leakage, than the centrically floating rotary valve. However, it will have slightly higher friction. This however is acceptable, because the eccentric floating obtained by this arrangement is not instabile, but stabile, because the forces onto the rotary valve member from the elements and pressure pockets is now higher, than the force onto the valve member out of the transfer channel(s) and its (their) sealing land(s).

What is claimed, is:

1. A valve arrangement including a rotary valve member (3,110) with a cylindrical outer face (330) is provided in a valve-bearing body (9,112);

wherein said body includes a valve-bearing bed of a hollow cylindrical configuration with a cylindrical inner face (333) of a constant radius about a longitudinal first axis;

wherein said valve member has a longitudinal second axis; and the cylindrical outer face of said member is formed by a second radius around said second axis, wherein said valve member is located in said bearing bed and able to revolve in said bed around said second axis;

wherein said second axis substantially coincides with said first axis when said member is inserted into said bed, wherein said second radius is substantially equal to said first radius, but very slightly shorter than said first radius to provide a narrow clearance between said outer face and said inner face;

wherein said valve-bearing body is provided with an entrance port;

wherein said rotary valve member is provided with at least one transfer passage (4,148,149);

wherein an inlet passage (8,15,25) is provided from said inlet port (f.e. 84) towards a portion of said outer face (380);

wherein said transfer passage extends through a portion of said member and through said outer face of said member;

wherein said valve-bearing body is provided with at least one transfer-channel (17,37,115) which is relative to said second axis located substantially radially of said transfer passage of said rotary valve member to periodically communicate and discommunicate with said transfer passage of said member, when said rotary valve member revolves in said bed of said valve-bearing body;

wherein pockets (23,153) are provided in said body with at least one pair of pockets provided in said body, while said pockets are open towards said outer face of said member, wherein one of said pockets is relatively to said axes axially distanced in one axial direction from said transfer passage while the other pocket of said pair of pockets is distanced from said transfer passage in the other axial direction relative to said axes, wherein said pockets are distanced substantially in equal lengths but oppositional axial directions from said transfer passage;

wherein said pockets are radially relative to said axes diametrically oppositionally located relative to said transfer channel;

wherein the clearance between said inner face and said outer face forms sealing lands around said transfer channel and around said pockets;

wherein said pockets are subjected to pressure in fluid and filled with fluid;

wherein said pressure in said fluid in said pockets extends in them gradually decreasing into said sealing lands around said pockets and the fluid pressure in said passage channel extends in it gradually decreasing into said sealing land around said transfer channel; whereby said pressures in said sealing lands form means value areas of pressure zones with pressures equal to said pressures in said pockets and in said transfer channel; and;

wherein the sum of the cross-sectional areas of the pressure zones of said pockets multiplied with the pressure therein corresponds substantially to the cross-sectional area of the pressure zone of said transfer channel multiplied by the pressure therein;

whereby said rotary valve member revolves in said bed of said valve bearing body substantially floating between said zones;

whereby said rotary valve member is substantially free of resulting radial forces to permit it to resolve substantially without friction between said inner face and said outer face, but to revolve instead between the fluids and pressures in said zones;

wherein a multiple fluids separation valve arrangement, (f.e. 769,166 or 85,) is communicated to said transfer channel and to said pockets;

wherein said pockets are communicated to a second fluid different from the first fluid in said transfer channel;

wherein said separation valve arrangement separates said second fluid from said first fluid, but controls the pressure in said pockets to maintain at all times at least periodically a parallelity of the rates of pressure in said fluids in said channel and in said pockets;

wherein said separation valve arrangement includes in a portion of a body a control cylinder (84) open at the first end thereof towards a portion of an outer face (333) of a moving member (93,3,110,310);

wherein a reciprocable control piston (85) is provided in said control cylinder (84);

wherein a thrust piston, also called: "element" (90) is provided axially of said control piston close to said first end of said control cylinder in said contol cylinder, whereby a top chamber (84) appears in said control cylinder close to the second end thereof and on the top end of said control piston (85), while a bottom chamber (94) appears between said control piston (85) and said element (90) in said control cylinder;

wherein a spring (87) is interposed between said control piston (85) and said element (90);

wherein a medial collection groove (86) meets a medial portion of said control piston (85) and a second communication passage (86) extends from said medial groove;

wherein a first communication passage (82) extends from said top chamber (84);

wherein a third communication passage (89) extends from a fluid supply source of a third pressure into said bottom chamber (94) of said control cylinder;

wherein a one-way check valve (88) is provided in said third communication passage (89); and;

wherein said second communication passage (86) is communicated to a room under substantially low pressure, while said first communication passage is communicated to a room containing a second pressure;

whereby said control piston oscillates under said second and third pressures in said chambers (84) and (94) and under the force of said spring to open and close said second communication passage and to increase and decrease the volumes of said chambers, while said element (thrust piston) (90) is pressed with its bottom portion against a respective face (330) of said moving member (93,3,110,310).

2. The arrangement of claim 1;

wherein said moving member is a rotary valve (3,93,110,310) while said face is a cylindrical outer face (333) with said second radius (332) around said second axis (331);

wherein said thrust piston (element) (90) forms a slide face (99) on its bottom portion with said first radius (334) around said first axis (335); and;

wherein said slide face (99) is pressed against a portion of said outer face (333) of said rotary valve (3,93,110,310);

whereby said rotary valve is pressed with a diametrically opposite portion of said outer face (333) against the respective transfer channel (17,115) to create and maintain a good sealing between said rotary valve and said transfer channel.

3. The arrangement of claim 2;

wherein said element (thrust piston) (90) is provied with a pocket (92) which is open towards and through said seal face (99) and communicated by a passage (91) to said bottom chamber (94);

wherein said first communication passage (82) is communicated to the working chamber (cylinder) (11) of a fluid operated (operating) engine (for example, combustion engine); and;

whereby lubrication and seal fluid is present in said pocket(s) (92,23,153) while said separation valve arrangement maintains a parallelity (or an equalness) of said pressures in said working chamber, (for example 11), of said engine and in said pocket(s) substantially parallel in timed relation to the varifying pressure of the periodic cycles of pressure in said working chamber of said engine.

4. A valve arrangement including a rotary valve member (3,110) with a cylindrical outer face (330) is provided in a valve-bearing body (9,112);

wherein said body includes a valve-bearing bed of a hollow cylindrical configuration with a cylindrical inner face (333) of a constant radius about a longitudinal first axis;

wherein said valve member has a longitudinal second axis; and the cylindrical outer face of said member is formed by a second radius around said second axis, wherein said valve member is located in said bearing bed and able to revolve in said bed around said second axis;

wherein said second axis substantially coincides with said first axis when said member is inserted into said bed, wherein said second radius is substantially equal to said first radius, but very slightly shorter than said first radius to provide a narrow clearance between said outer face and said inner face;

wherein said valve-bearing body is provided with an entrance port;

wherein said rotary valve member is provided with at least one transfer passage (4,148,149);

wherein an inlet passage (6,15,25) is provided from said inlet port (f.e. 84) towards a portion of said outer face (380);

wherein said transfer passage extends through a portion of said member and through said outer face of said member;

wherein said valve-bearing body is provided with at least one transfer-channel (17,37,115) which is relative to said second axis located substantially radially of said transfer passage of said rotary valve member to periodically communicate and discommunicate with said transfer passage of said member, when said rotary valve member revolves in said bed of said valve-bearing body;

wherein pockets (23,153) are provided in said body with at least one pair of pockets provided in said body, while said pockets are open towards said outer face of said member, wherein one of said pockets is relatively to said axes axially distanced in one axial direction from said transfer passsage while the other pocket of said pair of pockets is distanced from said transfer passage in the other axial direction relative to said axes, wherein said pockets are distanced substantially in equal lengths but oppositional axial directions from said transfer passage;

wherein said pockets are radially relative to said axes diametrically oppositionally located relative to said transfer channel;

wherein the clearance between said inner face and said outer face forms sealing lands around said transfer channel and around said pockets;

wherein said pockets are subjected to pressure in fluid and filled with fluid;

wherein said pressure in said fluid in said pockets extends in them gradually decreasing into said sealing lands around said pockets and the fluid pressure in said passage channel extends in it gradually decreasing into said sealing land around said transfer channel; whereby said pressures in said sealing lands form mean value areas of pressure zones with pressures equal to said pressures in said pockets and in said transfer channel; and;

wherein the sum of the cross-sectional areas of the pressure zones of said pockets multiplied with the pressure therein corresponds substantially to the cross-sectional area of the pressure zone of said transfer channel multiplied by the pressure therein;

whereby said rotary valve member revolves in said bed of said valve bearing body substantially floating between said zones;

whereby said rotary valve member is substantially free of resulting radial forces to permit it to resolve substantially without friction between said inner face and said outer face, but to revolve instead between the fluids and pressures in said zones;

wherein a multiple fluids separation valve arrangement, (f.e. 764,166 or 85,) is communicated to said transfer channel and to said pockets;

wherein said pockets are communicated to a second fluid different from the first fluid in said transfer channel;

wherein said separation valve arrangement separates said second fluid from said first fluid, but controls the pressure in said pockets to maintain at all times at least periodically a parallelity of the rates of pressure in said fluids in said channel and in said pockets;

wherein said separation valve arrangement includes a valve housing (159) with a therein provided space (167) with a therein axially movable element (control piston) (166);

wherein said housing is provided with a reception bore with a therein axially movable overflow piston (164);

wherein said space is divided by said piston element into a top-portion and a bottom portion, while said top portion is provided with a communication passage and said bottom portion is provided with an intermediate passage (163);

wherein said reception bore extends from said bottom portion;

wherein an entrance passage (160) is provided on the opposite end of said reception bore, whereby said overflow piston is subjected on its top end to the pressure in said bottom portion of said space, while the bottom end of said overflow piston is subjected to the pressure in said entrance passage;

wherein a medial groove is provided in said housing around the medial portion of said overflow piston and communicated to a space under low pressure;

wherein said overflow piston has on its bottom end flow-through slots 161 with cross-sectional areas wider at said bottom portion of said overflow piston and narrower towards said medial portion of said overflow piston;

wherein said communication passage is communicated to a first pressure, said intermediate passage is communicated to a second pressure and said entrance passage is communicated to a third pressure; and;

wherein a spring (165) is interposed between said element (166) and said top portion of said overflow piston (164);

whereby said element (control piston) (166) oscillates between said first and second pressures, while said overflow piston oscillates between said second and third pressures.

5. The arrangement of claim 4, wherein said communication passage (168) is communicated to a cylinder of an engine, said intermediate passage (163) is communicated to a neutral or zero pressure area and said entrance passage (160) is communicated to a source for supply of lubrication and seal fluid under pressure; and wherein said entrance passage (160) is also communicated to at least one fluid pressure pocket of said valve arrangement, whereby said element (control piston) (166) alternately compresses and decompresses said spring (165) in dependence on the pressure in said cylinder of said engine, while said overflow piston (164) controls the pressure of said lubrication and seal fluid substantially parallel in timed relation to said pressure in said cylinder to maintain substantially at all respective times at least a parallelity of rate of pressures in said cylinder and in said lubrication and seal fluid.

* * * * *